US010365577B2

(12) United States Patent
Kuramoto

(10) Patent No.: US 10,365,577 B2
(45) Date of Patent: Jul. 30, 2019

(54) IMAGE FORMING APPARATUS

(71) Applicant: FUJI XEROX CO., LTD., Tokyo (JP)

(72) Inventor: Kazuki Kuramoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/796,866

(22) Filed: Oct. 30, 2017

(65) Prior Publication Data

US 2018/0284637 A1 Oct. 4, 2018

(30) Foreign Application Priority Data

Mar. 29, 2017 (JP) ..... 2017-065169

(51) Int. Cl.
*G03G 15/02* (2006.01)

(52) U.S. Cl.
CPC ..... *G03G 15/0266* (2013.01); *G03G 15/02* (2013.01); *G03G 15/0283* (2013.01)

(58) Field of Classification Search
CPC . G03G 15/0266; G03G 15/0283; G03G 15/02
See application file for complete search history.

(56) References Cited

U.S. PATENT DOCUMENTS 5,646,717 A * 7/1997 Hiroshima ..... G03G 15/0266 399/10

FOREIGN PATENT DOCUMENTS

| | | |
|---|---|---|
| JP | 2013-117673 | 6/2013 |
| JP | 2013-125263 | 6/2013 |
| JP | 2014-059461 | 4/2014 |
| JP | 2017040800 A * | 2/2017 |

OTHER PUBLICATIONS

English Translation of JP-2017040800-A Watanabe Feb. 23, 2017 (Year: 2017).*

* cited by examiner

*Primary Examiner* — Ryan D Walsh
(74) *Attorney, Agent, or Firm* — JCIPRNET

(57) ABSTRACT

An image forming apparatus includes an image bearing member and a charging member that electrostatically charges a surface of the image bearing member. Control is performed for increasing a voltage to be applied to the charging member in a stepwise manner so that the voltage becomes higher than when the image bearing member passes through a region where the image bearing member faces the charging member in a previous rotation, the control being performed as the image bearing member rotates while a single image region worth of image is being formed in an image region that is longer than a length equivalent to one rotation of the image bearing member in a rotational direction of the image bearing member.

15 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2017-065169 filed Mar. 29, 2017.

BACKGROUND

Technical Field

The present invention relates to image forming apparatuses.

SUMMARY

According to an aspect of the invention, there is provided an image forming apparatus including an image bearing member and a charging member that electrostatically charges a surface of the image bearing member. Control is performed for increasing a voltage to be applied to the charging member in a stepwise manner so that the voltage becomes higher than when the image bearing member passes through a region where the image bearing member faces the charging member in a previous rotation, the control being performed as the image bearing member rotates while a single image region worth of image is being formed in an image region that is longer than a length equivalent to one rotation of the image bearing member in a rotational direction of the image bearing member.

BRIEF DESCRIPTION OF THE DRAWINGS

An exemplary embodiment of the present invention will be described in detail based on the following figures, wherein.

DETAILED DESCRIPTION

Figure 1:
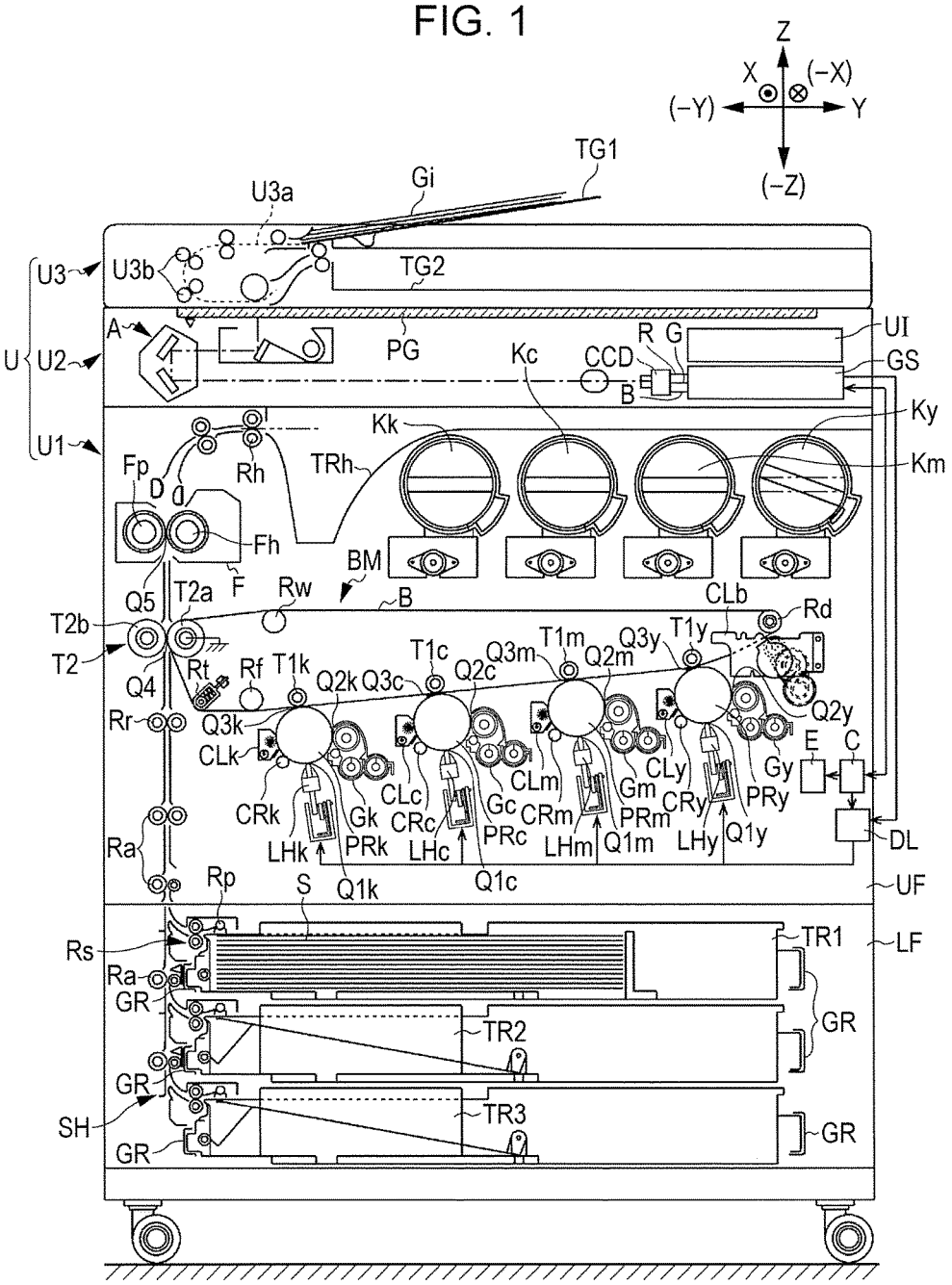
FIG. 1 illustrates an image forming apparatus according to a first exemplary embodiment.

Although a specific exemplary embodiment of the present invention will be described below with reference to the drawings, the present invention is not to be limited to the following exemplary embodiment.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, −X, Y, −Y, Z, and −Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those for providing an easier understanding of the description are omitted where appropriate.

First Exemplary Embodiment

FIG. 1 illustrates an image forming apparatus according to a first exemplary embodiment.

Figure 2:
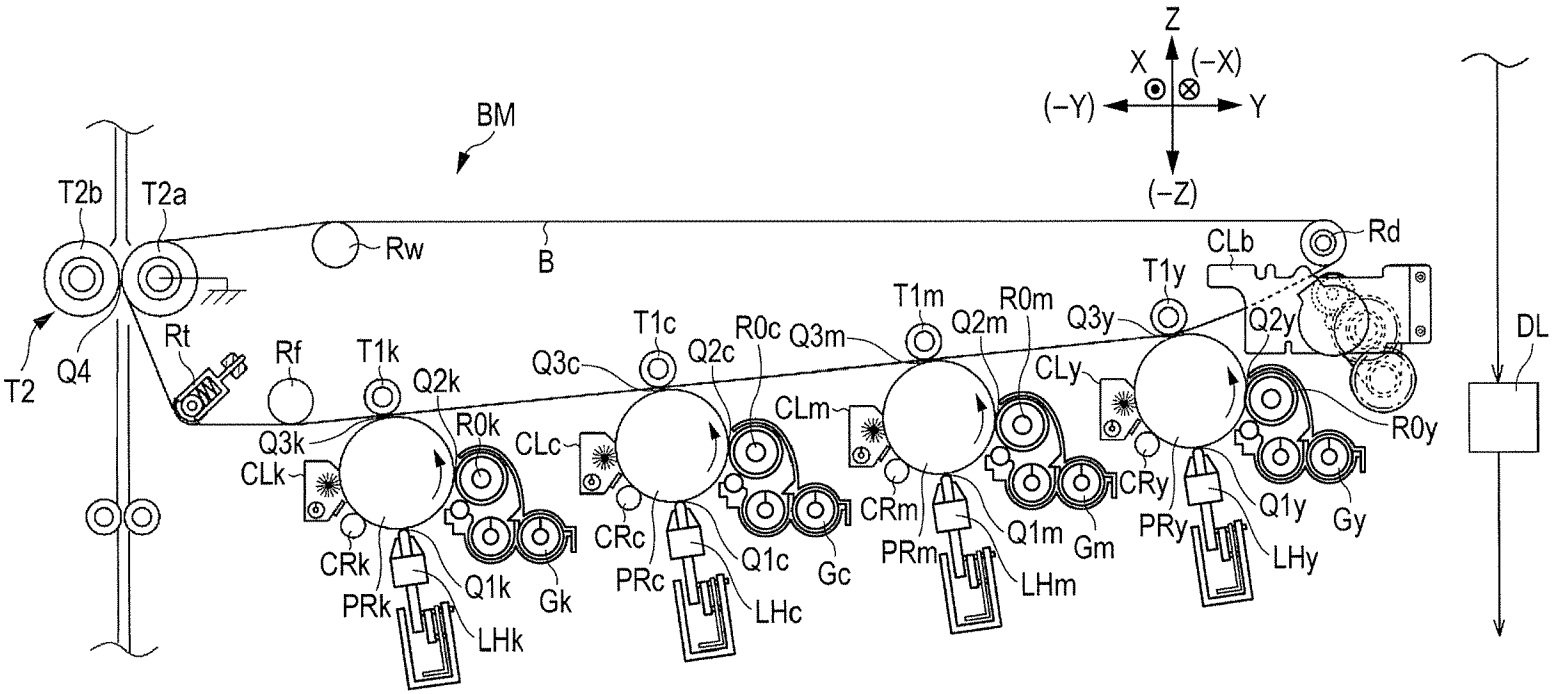
FIG. 2 illustrates a relevant part of the image forming apparatus according to the first exemplary embodiment.

FIG. 2 illustrates a relevant part of the image forming apparatus according to the first exemplary embodiment.

In FIG. 1, a copier U as an example of the image forming apparatus according to the first exemplary embodiment of the present invention is an example of an apparatus body and has a printer unit U1 as an example of an image recording device. A scanner unit U2 as an example of a reader as well as an example of an image reading device is supported at the upper portion of the printer unit U1. An auto feeder U3 as an example of a document transport device is supported at the upper portion of the scanner unit U2. The scanner unit U2 according to the first exemplary embodiment supports a user interface UI as an example of an input unit. An operator may input information to the user interface UI so as to operate the copier U.

A document tray TG1 as an example of a medium container is disposed at the upper portion of the auto feeder U3. The document tray TG1 is capable of accommodating a stack of multiple documents Gi to be copied. A document output tray TG2 as an example of a document output unit is provided below the document tray TG1. Document transport rollers U3*b* are arranged along a document transport path U3*a* between the document tray TG1 and the document output tray TG2.

Platen glass PG as an example of a transparent document table is disposed at the upper surface of the scanner unit U2. In the scanner unit U2 according to the first exemplary embodiment, a reading optical system A is disposed below the platen glass PG. The reading optical system A according to the first exemplary embodiment is supported in a movable manner in the left-right direction along the lower surface of the platen glass PG. Normally, the reading optical system A is in a stopped state at an initial position shown in FIG. 1.

An imaging element CCD as an example of an imaging member is disposed to the right of the reading optical system A. The imaging element CCD is electrically connected to an image processor GS.

The image processor GS is electrically connected to a write circuit DL of the printer unit U1. The write circuit DL is electrically connected to light-emitting-diode (LED) heads LHy, LHm, LHc, and LHk as an example of latent-image forming devices.

Photoconductor drums PRy, PRm, PRc, and PRk as an example of image bearing members are respectively disposed above the LED heads LHy to LHk.

Charging rollers CRy, CRm, CRc, and CRk as an example of charging units are respectively disposed facing the photoconductor drums PRy to PRk. The charging rollers CRy to CRk receive a charge voltage from a power supply circuit E. The charging rollers CRy, CRm, CRc, and CRk according to the first exemplary embodiment are supplied with electric power by using a direct-current power source. Specifically, although the charge voltage in the first exemplary embodiment is a direct-current voltage alone and does not have an alternating-current voltage superposed thereon, an alternating current may be superposed on a direct current.

The power supply circuit E is controlled by a controller C. The controller C performs various kinds of control by exchanging signals with, for example, the image processor GS and the write circuit DL.

In write regions Q1*y*, Q1*m*, Q1*c*, and Q1*k* set downstream of the charging rollers CRy to CRk in the rotational direction of the photoconductor drums PRy to PRk, the LED heads LHy to LHk radiate write light onto the surfaces of the photoconductor drums PRy to PRk.

In developing regions Q2*y*, Q2*m*, Q2*c*, and Q2*y* set downstream of the write regions Q1*y* to Q1*k* in the rotational direction of the photoconductor drums PRy to PRk, developing devices Gy, Gm, Gc, and Gk are disposed facing the surfaces of the respective photoconductor drums PRy to PRk.

First-transfer regions Q3*y*, Q3*m*, Q3*c*, and Q3*k* are set downstream of the developing regions Q2*y* to Q2*y* in the rotational direction of the photoconductor drums PRy to PRk. In the first-transfer regions Q3*y* to Q3*k*, the photoconductor drums PRy to PRk are in contact with an intermediate transfer belt B as an example of an intermediate transfer member as well as an example of a medium. Furthermore, in the first-transfer regions Q3*y*, Q3*m*, Q3*c*, and Q3*k*, first-transfer rollers T1*y*, T1*m*, T1*c*, and T1*k* as an example of first-transfer units as well as an example of transfer members are disposed opposite the photoconductor drums PRy to PRk with the intermediate transfer belt B interposed therebetween. In the first exemplary embodiment, a first-transfer voltage to be applied to the first-transfer rollers T1*y* to T1*k* undergoes so-called constant current control such that an electric current value to be supplied becomes a preset value.

Drum cleaners CLy, CLm, CLc, and CLk as an example of image-bearing-member cleaning units are disposed downstream of the first-transfer regions Q3*y* to Q3*k* in the rotational direction of the photoconductor drums PRy to PRk. The copier U according to the first exemplary embodiment is not provided with a charge remover that removes electric charge from the surfaces of the photoconductor drums PRy to PRk after passing through the first-transfer regions Q3*y* to Q3*k*.

A belt module BM as an example of an intermediate transfer device is disposed above the photoconductor drums PRy to PRk. The belt module BM has the aforementioned intermediate transfer belt B. The intermediate transfer belt B is supported in a rotatable manner by a driving roller Rd as an example of a driving member, a tension roller Rt as an example of a tension member, a working roller Rw as an example of a meander correction member, an idler roller Rf as an example of a driven member, a backup roller T2*a* as an example of a second-transfer-region opposing member, and the first-transfer rollers T1*y*, T1*m*, T1*c*, and T1*k*.

A second-transfer roller T2*b* as an example of a second-transfer member is disposed opposite the backup roller T2*a* with the intermediate transfer belt B interposed therebetween. The backup roller T2*a* and the second-transfer roller T2*b* constitute a second-transfer unit T2. A second-transfer region Q4 is formed by a region where the second-transfer roller T2*b* and the intermediate transfer belt B face each other.

For example, the first-transfer rollers T1*y* to T1*k*, the intermediate transfer belt B, and the second-transfer unit T2 constitute a transfer device T1+T2+B according to the first exemplary embodiment that transfers images formed on the photoconductor drums PRy to PRk onto a medium.

A belt cleaner CLb as an example of an intermediate-transfer-member cleaning unit is disposed downstream of the second-transfer region Q4 in the rotational direction of the intermediate transfer belt B.

Cartridges Ky, Km, Kc, and Kk as an example of developer containers are disposed above the belt module BM. The cartridges Ky to Kk accommodate developers to be supplied to the developing devices Gy to Gk. The cartridges Ky to Kk and the developing devices Gy to Gk are respectively connected by developer supplying devices (not shown).

Feed trays TR1 to TR3 as an example of medium containers are disposed at the lower portion of the printer unit Ui. The feed trays TR1 to TR3 are supported in a detachable manner in the front-rear direction by guide rails GR as an example of guide members. The feed trays TR1 to TR3 accommodate sheets S therein as an example of media.

A pickup roller Rp as an example of a medium pickup member is disposed at the upper left side of each of the feed trays TR1 to TR3. A separation roller Rs as an example of a separation member is disposed to the left of the pickup roller Rp.

A medium transport path SH extending upward is provided to the left of the feed trays TR1 to TR3. The transport path SH has multiple transport rollers Ra arranged therein as an example of medium transport members. In a downstream area of the transport path SH in the transport direction of the sheet S, a registration roller Rr as an example of a delivery member is disposed upstream of the second-transfer region Q4.

A fixing device F is disposed above the second-transfer region Q4. The fixing device F has a heating roller Fh as an example of a heating member, and also has a pressure roller Fp as an example of a pressure member. A contact region between the heating roller Fh and the pressure roller Fp constitutes a fixing region Q5.

An output roller Rh as an example of a medium transport member is disposed obliquely above the fixing device F. An output tray TRh as an example of a medium output unit is provided to the right of the output roller Rh.

Image Forming Operation

The multiple documents Gi accommodated in the document tray TG1 sequentially pass over a document read position on the platen glass PG and are output onto the document output tray TG2.

In a case where copying is to be performed by transporting the documents Gi automatically by using the auto feeder U3, the documents Gi sequentially passing over the read position on the platen glass PG are exposed to light with the reading optical system A maintained in the stopped state at the initial position.

In a case where copying is to be performed by allowing the operator to manually place a document Gi on the platen glass PG, the reading optical system A moves in the left-right direction so that the document Gi on the platen glass PG is scanned while being exposed to light.

Reflected light from the document Gi travels through the reading optical system A and is focused on the imaging element CCD. The imaging element CCD converts the reflected light from the document Gi focused on an imaging surface thereof into red (R), green (G), and blue (B) electric signals.

The image processor GS converts the RGB electric signals input from the imaging element CCD into black (K), yellow (Y), magenta (M), and cyan (C) image information and temporarily stores the image information. The image processor GS outputs the temporarily-stored image information as image information for latent-image formation to the write circuit DL at a predetermined timing.

If the document image is a monochromatic image, only the black (K) image information is input to the write circuit DL.

The write circuit DL has Y, M, C, and K drive circuits (not shown). The write circuit DL outputs signals according to the input image information at a predetermined timing to the LED heads LHy to LHk arranged for the respective colors.

The surfaces of the photoconductor drums PRy to PRk are electrostatically charged by the charging rollers CRy to CRk. In the write regions Q1*y* to Q1*k*, the LED heads LHy to LHk form electrostatic latent images on the surfaces of the photoconductor drums PRy to PRk. In the developing regions Q2*y* to Q2*y*, the developing devices Gy to Gk develop the electrostatic latent images on the surfaces of the photoconductor drums PRy to PRk into toner images as an example of visible images. When the developers are consumed in the developing devices Gy to Gk, the developing devices Gy to Gk are supplied with new developers from the respective cartridges Ky to Kk in accordance with the consumed amounts.

The toner images on the surfaces of the photoconductor drums PRy to PRk are transported to the first-transfer regions Q3*y*, Q3*m*, Q3*c*, and Q3*k*. The first-transfer rollers T1*y* to T1*k* receive a first-transfer voltage with a polarity opposite from the charge polarity of the toners from the power supply circuit E at a predetermined timing. Therefore, in the first-transfer regions Q3*y* to Q3*k*, the toner images on the photoconductor drums PRy to PRk are sequentially superposed and transferred onto the intermediate transfer belt B in accordance with the first-transfer voltage. In the case of a K monochromatic image, the K toner image alone is transferred onto the intermediate transfer belt B from the K photoconductor drum PRk.

The toner images on the photoconductor drums PRy to PRk are first-transferred onto the intermediate transfer belt B as an example of an intermediate transfer member by the first-transfer rollers T1*y*, T1*m*, T1*c*, and T1*k*. Residues and extraneous matter on the surfaces of the photoconductor drums PRy to PRk after the first-transfer process are cleaned off by the drum cleaners CLy to CLk. The cleaned surfaces of the photoconductor drums PRy to PRk are electrostatically charged again by the charging rollers CRy to CRk.

A sheet S from one of the feed trays TR1 to TR3 is picked up by the corresponding pickup roller Rp at a predetermined feed timing. If multiple sheets S in a stacked state are picked up by the pickup roller Rp, the separation roller Rs separates the sheets S in a one-by-one fashion. The sheet S that has passed the separation roller Rs is transported to the registration roller Rr by the multiple transport rollers Ra.

The registration roller Rr delivers the sheet S in accordance with the timing at which the toner images on the surface of the intermediate transfer belt B move to the second-transfer region Q4.

When the sheet S delivered from the registration roller Rr passes through the second-transfer region Q4, the toner images on the surface of the intermediate transfer belt B are transferred onto the sheet S in accordance with a second-transfer voltage applied to the second-transfer roller T2*b*.

After the intermediate transfer belt B passes through the second-transfer region Q4, the belt cleaner CLb cleans the surface of the intermediate transfer belt B by removing residual toner therefrom.

The sheet S that has passed through the second-transfer region Q4 subsequently passes through the fixing region Q5 where the toner images are fixed onto the sheet S by being heated and pressed by the fixing device F.

The sheet S having the toner images fixed thereon is output to the output tray TRh by the output roller Rh.

Controller According to First Exemplary Embodiment

Figure 3:
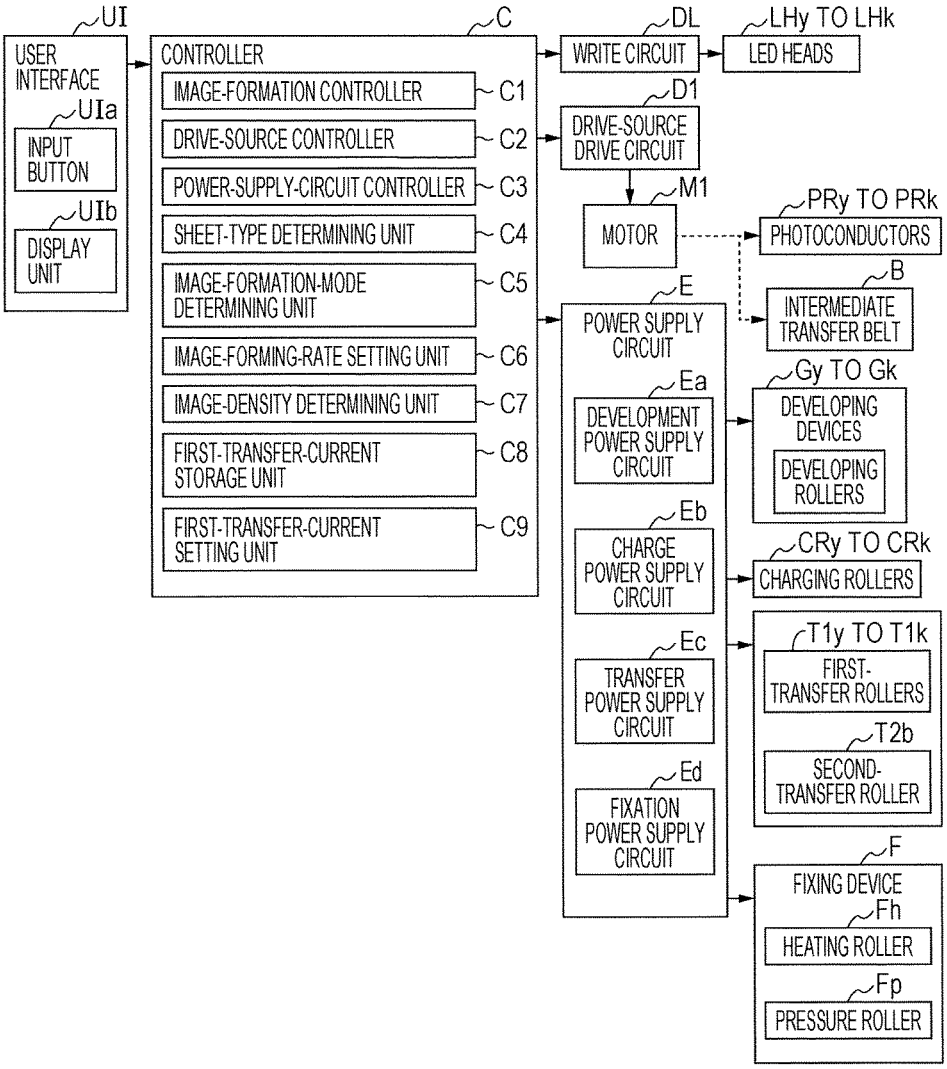
FIG. 3 is a block diagram illustrating functions included in a controller of the image forming apparatus according to the first exemplary embodiment.

FIG. 3 is a block diagram illustrating functions included in the controller of the image forming apparatus according to the first exemplary embodiment.

In FIG. 3, the controller C has an input-output interface I/O used for, for example, receiving and outputting signals from and to the outside. Furthermore, the controller C has a read-only memory (ROM) that stores, for example, programs and information used for performing processes. The controller C also has a random access memory (RAM) for temporarily storing data. Moreover, the controller C has a central processing unit (CPU) that performs a process according to a program stored in, for example, the ROM. Therefore, the controller C according to the first exemplary embodiment is constituted by a small-size information processing device, that is, a so-called microcomputer. Accordingly, the controller C is capable of realizing various functions by executing the programs stored in, for example, the ROM.

Signal Output Components Connected to Controller C

The controller C receives output signals from signal output components, such as the user interface UI and sensors (not shown).

The user interface UI includes an input button UIa as an example of an input member for inputting, for example, an arrow. The user interface UI also includes, for example, a display unit UIb as an example of a notification member.

Controlled Components Connected to Controller C

The controller C is connected to a drive-source drive circuit D1, the write circuit DL, the power supply circuit E, and other controlled components (not shown). The controller C outputs control signals to, for example, the circuits D1 and E.

The drive-source drive circuit D1 rotationally drives, for example, the photoconductor drums PRy to PRk and the intermediate transfer belt B via a motor M1 as an example of a drive source.

The write circuit DL controls the LED heads LHy to LHk so as to form latent images on the photoconductor drums PRy to PRk.

The power supply circuit E includes a development power supply circuit Ea, a charge power supply circuit Eb, a transfer power supply circuit Ec, and a fixation power supply circuit Ed.

The development power supply circuit Ea applies a development voltage to developing rollers of the developing devices Gy to Gk.

The charge power supply circuit Eb applies a charge voltage to the charging rollers CRy to CRk so as to electrostatically charge the surfaces of the photoconductor drums PRy to PRk.

The transfer power supply circuit Ec applies a transfer voltage to the first-transfer rollers T1*y* to T1*k* and the backup roller T2*a*.

The fixation power supply circuit Ed supplies electric power to an induction heater 8 for the heating roller Fh of the fixing device F.

Functions of Controller C

The controller C has a function of executing processes according to input signals from the signal output components and outputting control signals to the controlled components. Specifically, the controller C has the following functions.

An image-formation controller Cl controls, for example, the driving of each component in the copier U and the voltage application timing in accordance with image information read by the scanner unit U2 or image information input from, for example, an external personal computer so as to execute a job, which is an image forming operation.

A drive-source controller C2 controls the driving of the motor M1 via the drive-source drive circuit D1 so as to control the driving of, for example, the photoconductor drums PRy to PRk.

A power-supply-circuit controller C3 controls the power supply circuits Ea to Ed so as to control the voltage to be applied to each component and the electric power to be supplied to each component.

A sheet-type determining unit C4 determines the type of medium to be used for printing. In the first exemplary embodiment, information about the types of sheets accommodated in the feed trays TR1 to TR3 is registered in advance, and the sheet type is determined by acquiring the registered sheet-type information with respect to one of the feed trays TR1 to TR3 from which sheets are to be fed. Examples of the registered sheet types include basis weights, such as thin paper, plain paper, thick paper, and overhead projector (OHP) sheets, and sizes of media, such as A3, A4, and B5 sizes, which are distinguishable from one another.

An image-formation-mode determining unit C5 determines an image print mode in accordance with an input to the user interface UI. Examples of image formation modes to be determined by the image-formation-mode determining unit C5 according to the first exemplary embodiment include a black monochrome print mode, that is, a so-called monochrome mode, and a full-color print mode, that is, a so-called full-color mode.

An image-forming-rate setting unit C6 sets the image forming rate in the copier U. For example, the image-forming-rate setting unit C6 according to the first exemplary embodiment sets the image forming rate to either a first image forming rate PS1 or a second image forming rate PS2 that is higher than the first image forming rate PS1. The image-forming-rate setting unit C6 according to the first exemplary embodiment sets the image forming rate to the first image forming rate PS1, which is the lower rate, if the sheet type is thick paper or an OHP sheet, and sets the image forming rate to the second image forming rate PS2, which is the higher rate, if the sheet type is plain paper or thin paper. Furthermore, the image-forming-rate setting unit C6 according to the first exemplary embodiment sets the image forming rate to the first image forming rate PS1, which is the lower rate, in a case where the image forming operation is in the full-color mode, and sets the image forming rate to the second image forming rate PS2, which is the higher rate, in a case where the image forming operation is in the monochrome mode. Therefore, in the first exemplary embodiment, the image forming rate is set to the second image forming rate PS2 if the sheet type is plain paper or thin paper and the image forming operation is in the monochrome mode. Otherwise, the image forming rate is set to the first image forming rate PS1.

An image-density determining unit (charge-removing-ability determining unit) C7 determines the density of an image to be printed. The image-density determining unit C7 according to the first exemplary embodiment calculates the density of one page worth of an image to be written by each of the LED heads LHy to LHk based on the percentage of the number of pixels of the image relative to the total number of pixels. If the calculated density of the image reaches a predetermined threshold value, the image-density determining unit C7 determines that the image is a high-density image. The threshold value may be set to, for example, 10%. Furthermore, if the image density reaches the threshold value, the image-density determining unit C7 according to the first exemplary embodiment determines that the first-transfer rollers T1*y* to T1*k* also functioning as charge removing members lack a charge removing ability. If the image density reaches the threshold value, the image-density determining unit C7 according to the first exemplary embodiment determines that the first-transfer rollers T1*y* to T1*k* have a sufficient charge removing ability.

Figure 4:
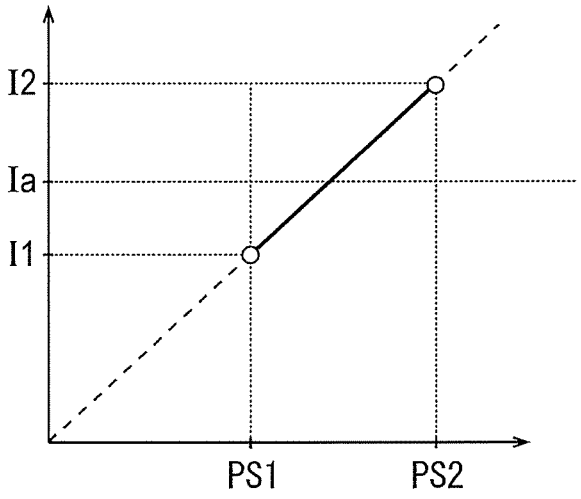
FIG. 4 is a graph illustrating the settings of first-transfer currents in the first exemplary embodiment, in which the abscissa axis denotes an image forming rate and the ordinate axis denotes a first-transfer current.

FIG. 4 is a graph illustrating the settings of first-transfer currents in the first exemplary embodiment, in which the abscissa axis denotes an image forming rate and the ordinate axis denotes a first-transfer current.

A first-transfer-bias setting unit C8 sets a first-transfer bias (charge removal bias) to be supplied to the first-transfer rollers T1*y* to T1*k* during an image forming operation. Referring to FIG. 4, the first-transfer-bias setting unit C8 according to the first exemplary embodiment performs the setting process such that a first first-transfer current I1 is supplied as a first first-transfer bias to the first-transfer rollers T1*y* to T1*k* in the case of the first image forming rate PS1 and that a second first-transfer current I2 is supplied as a second first-transfer bias in the case of the second image forming rate PS2. The first first-transfer current I1 and the second first-transfer current I2 are set to have the relationship I1:I2=PS1:PS2. Specifically, the transfer currents I1 and I2 are controlled so as to be proportional to the image forming rate.

A first-transfer-bias determining unit (charge-removing-ability determining unit) C9 determines whether or not the first-transfer bias set by the first-transfer-bias setting unit C8 reaches a predetermined threshold value Ia. The first-transfer-bias determining unit C9 according to the first exemplary embodiment determines whether or not the charge removing ability of the first-transfer rollers T1*y* to T1*k* reaches a predetermined charge removing ability depending on whether or not the first-transfer bias to be supplied to the first-transfer rollers T1*y* to T1*k* also functioning as charge removing members reaches the threshold value Ia. For example, the threshold value Ia is set to have the relationship I1<Ia<I2. Therefore, in the first exemplary embodiment, it is determined that the first-transfer current I1 does not reach the threshold value Ia if the image forming rate is the low rate PSi, and that the first-transfer current I2 reaches the threshold value Ia if the image forming rate is the high rate PS2.

Figure 5A:
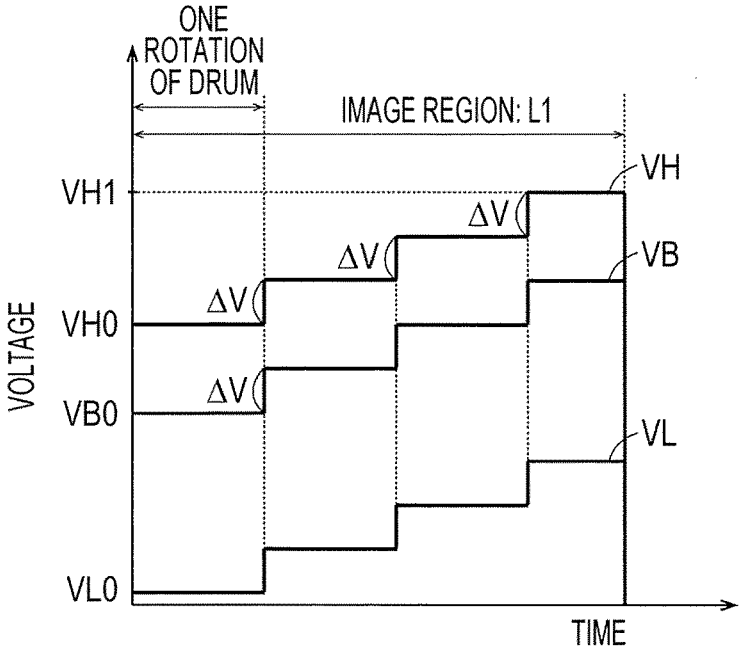
FIGS. 5A and 5B illustrate charge voltages according to the first embodiment, FIG. 5A illustrating a case where an image region is large, FIG. 5B illustrating a case where the image region is small.
Figure 5B:
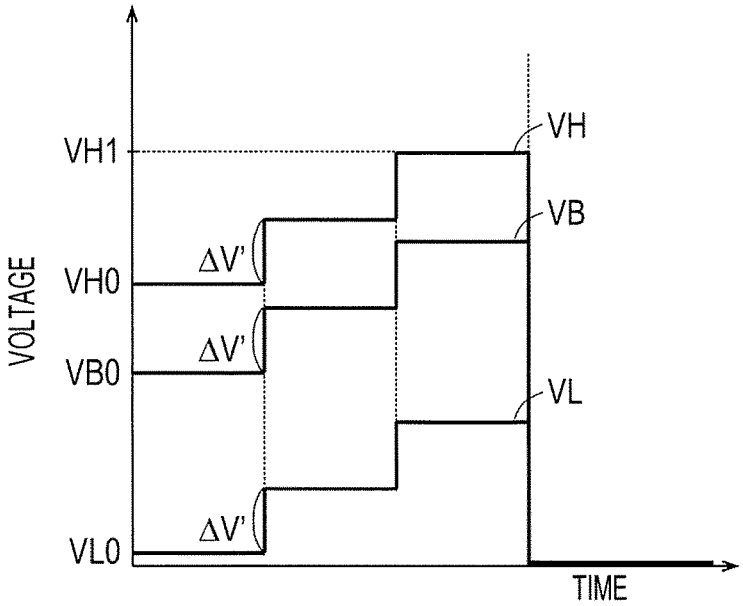

FIGS. 5A and 5B illustrate charge voltages according to the first embodiment. Specifically, FIG. 5A illustrates a case where an image region is large, and FIG. 5B illustrates a case where the image region is small.

In FIGS. 5A and 5B, the abscissa axis denotes time and the ordinate axis denotes voltage.

A charge-bias controller C10 controls the charge bias to be supplied to the charging rollers CRy to CRk during an image forming operation. In FIGS. 5A and 5B, the charge-bias controller C10 according to the first exemplary embodiment increases a voltage Vdc to be applied to the charging rollers CRy to CRk in a stepwise manner as the photoconductor drums PRy to PRk rotate while a single image region L1 worth of image is being formed in an image region L1 that is longer than a length L0 equivalent to one rotation of the photoconductor drums PRy to PRk in the rotational direction of the photoconductor drums PRy to PRk. The image region L1 is set in correspondence with the size (e.g., A3, A4, or B5) of a sheet S to be used. In a case where the charge bias Vdc is to be applied to the charging rollers CRy to CRk, the surfaces of the photoconductor drums PRy to PRk are electrostatically charged to a charge potential VH whose absolute value is smaller than that of the charge bias Vdc.

In the charge-bias controller C10 according to the first exemplary embodiment, every time a time period equivalent to one rotation L0 of the photoconductor drums PRy to PRk elapses, the charge bias Vdc is increased in a stepwise manner in increments of ΔV or ΔV'. The increments ×V and ΔV' are set based on the length of the image region L1. In the first exemplary embodiment, the increment ΔV or ΔV' is calculated from the image region L1, one rotation L0 of the photoconductor drums PRy to PRk, an initial value Vdc0 of the charge voltage, and an upper limit value Vmax of the charge voltage. Therefore, in a case where a value obtained by rounding off L1/L0 to the nearest decimal is defined as La, the increment ΔV or ΔV' is set in accordance with the following expression (1):

$$\Delta V=(V\max-Vdc0)/La \quad (1)$$

Therefore, with regard to the increment ΔV or ΔV' set based on expression (1), the increment ΔV or ΔV' decreases with increasing length of the image region L1. The upper limit value Vmax of the charge voltage is set in advance in view of, for example, the performance and safety of the power supply circuit E and the endurable voltage with respect to the materials of the charging rollers CRy to CRk and the photoconductor drums PRy to PRk. Similar to the above-described case where the surface potential of the photoconductor drums PRy to PRk becomes VH when the charge bias Vdc is applied, the surface potential of the photoconductor drums PRy to PRk becomes VH1 when the charge bias Vmax is applied.

Figure 6A:
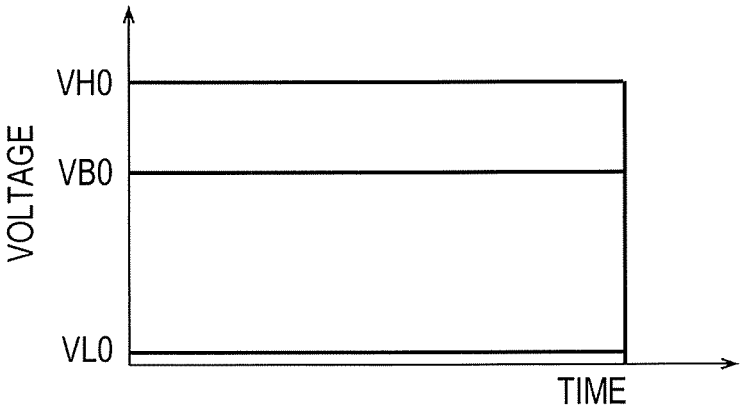
FIGS. 6A and 6B illustrate charge biases according to the first exemplary embodiment, FIG. 6A illustrating a charge voltage in a case where a charge removing ability is sufficient, FIG. 6B illustrating another example of control of a charge voltage in a case where the charge removing ability is insufficient.
Figure 6B:
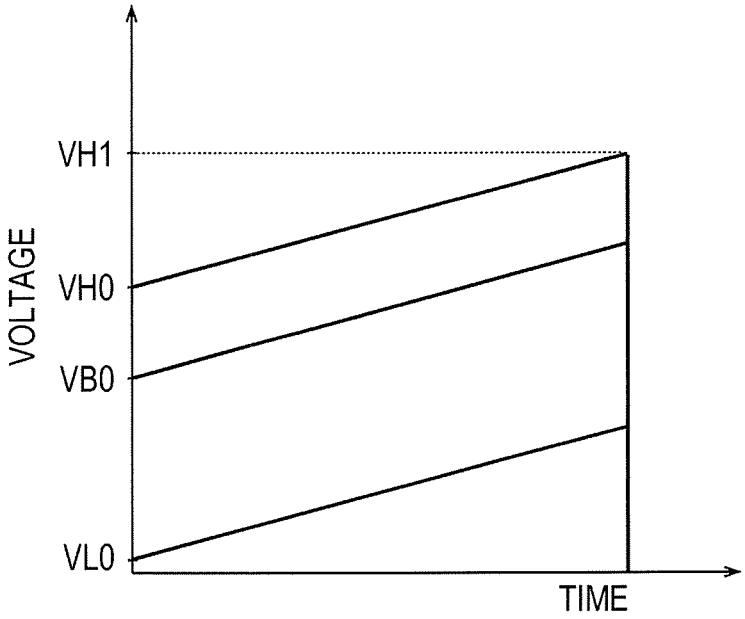

FIGS. 6A and 6B illustrate charge biases according to the first exemplary embodiment. Specifically, FIG. 6A illustrates a charge voltage in a case where the charge removing ability is sufficient, and FIG. 6B illustrates another example of control of a charge voltage in a case where the charge removing ability is insufficient.

In a case where the first-transfer-bias determining unit C9 determines that the first-transfer bias does not reach the threshold value Ia, the charge-bias controller C10 according to the first exemplary embodiment executes control for increasing the charge bias Vdc in a stepwise manner during an image forming operation, as shown in FIGS. 5A and 5B. Furthermore, in a case where the image-density determining unit C7 determines that the image density reaches the threshold value, the charge-bias controller C10 according to the first exemplary embodiment executes control for increasing the charge bias Vdc in a stepwise manner during the image forming operation, as shown in FIGS. 5A and 5B. Then, if the first-transfer bias reaches the threshold value Ia and the image density does not reach the threshold value, the charge bias Vdc is controlled to a fixed value during the image forming operation, as shown in FIG. 6A. Specifically, the charge bias Vdc is maintained.

Although the charge-bias controller C10 according to the first exemplary embodiment is configured to increase the charge bias in a stepwise manner, as shown in FIGS. 5A and 5B, the charge-bias controller C10 is not limited to this configuration. For example, as shown in FIG. 6B, control may be performed for continuously increasing the charge bias as the photoconductor drums PRy to PRk rotate. In the case shown in FIG. 6B, the gradient of a straight line along which the charge bias Vdc is increased may be set based on the upper limit value Vmax of the charge voltage and the length of the image region L1.

A development-bias controller C11 controls a development bias VB to be supplied to the developing rollers of the developing devices G during an image forming operation. Referring to FIGS. 5A, 5B, 6A, and 6B, the development-bias controller C11 according to the first exemplary embodiment performs control in conjunction with the charge bias Vdc controlled by the charge-bias controller C10. Therefore, as shown in FIGS. 5A, 5B, and 6B, if the charge bias Vdc is to be increased during an image forming operation, the development bias VB is also increased in conjunction therewith. If the charge bias Vdc is fixed, as shown in FIG. 6A, the development bias VB is also fixed. In the controller C according to the first exemplary embodiment, the power-supply-circuit controller C3 controls the biases by supplying the biases to the first-transfer rollers T1*y* to T1*k*, the charging rollers CRy to CRk, and the developing rollers based on the biases set by the first-transfer-bias setting unit C8, the charge-bias controller C10, and the development-bias controller C11.

A latent-image-forming-device output controller C12 controls an output when latent images are to be formed by the LED heads LHy to LHk during an image forming operation. Referring to FIGS. 5A to 6B, the latent-image-forming-device output controller C12 according to the first exemplary embodiment performs control in conjunction with the charge bias Vdc controlled by the charge-bias controller C10. Basically, when the charge bias Vdc is increased during an image forming operation, the surface potential VH of the photoconductor drums PRy to PRk increases, and the electric potential VL of the photoconductor drums PRy to PRk exposed to light also increases. However, the amount of increase in the electric potential VL of the exposure units may sometimes be smaller than the amount of increase in the surface potential VH after the charging process. In that case, the output of the LEDs constituting the LED heads LHy to LHk is reduced, so that the relationship of the potential difference among the electric potentials VH, VB, and VL is fixed. When the output of the LEDs is reduced, the amount of light radiated onto the photoconductor drums PRy to PRk decreases, and the electric potential VL of the photoconductor drums PRy to PRk exposed to light increases, thus following the increase of the surface potential VH after the charging process. Furthermore, as shown in FIG. 6A, when the charge bias Vdc is fixed, the output of the LED heads LHy to LHk is also fixed.

Operation of First Exemplary Embodiment

In the copier U according to the first exemplary embodiment having the above-described configuration, the image forming rate PS1 or PS2 is set in accordance with the sheet type and the image formation mode. The first-transfer bias (i.e., first-transfer current I1 or 12) is set in accordance with the image forming rate PS1 or PS2. In the first-transfer regions Q3*y* to Q3*k*, images are transferred onto the intermediate transfer belt B by using the first-transfer voltage applied to the first-transfer rollers T1*y* to T1*k*. With regard to the first-transfer voltage, a voltage with a polarity opposite from that of the charge voltage of the photoconductor drums PRy to PRk is applied. Therefore, when the photoconductor drums PRy to PRk pass through the first-transfer regions Q3*y* to Q3*k*, electric charge is removed from the surfaces of the photoconductor drums PRy to PRk by using the first-transfer voltage. When the image forming rate is the low rate, if the first-transfer current decreases in proportion thereto, the transfer ability is maintained, but the charge removing ability deteriorates. Thus, the electric charge is not sufficiently removed from the surfaces of the photoconductor drums PRy to PRk.

Figure 7:
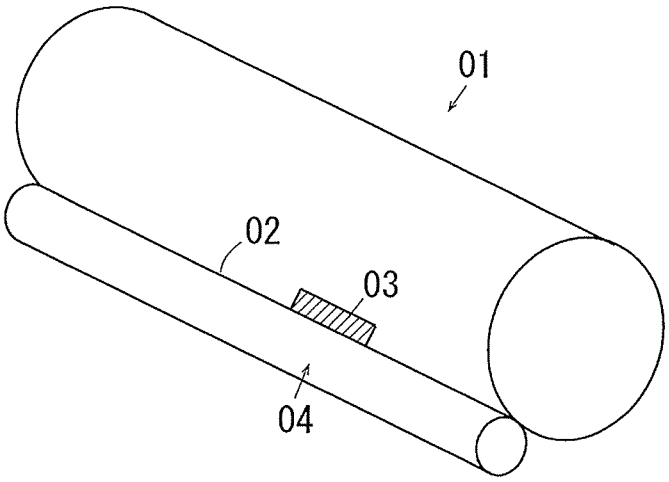
FIG. 7 RELATED ART
FIG. 7 illustrates a case where defective charging occurs in the related art.

FIG. 7 illustrates a case where defective charging occurs in the related art.

Referring to FIG. 7, if electric charge is not sufficiently removed from a photoconductor drum 01, for example, it is assumed that a region 02 where the residual potential is −100 V and a region 03 where the residual potential is −300 V are formed on the surface of the photoconductor drum 01. If the target surface potential VH of the photoconductor drum 01 is −400 V, the potential difference with the region 02 becomes 300 V, and the potential difference with the region 03 becomes 100 V. Therefore, when passing through a charging region, the potential difference becomes sufficient in the region 02 so that discharging occurs, whereby the surface potential readily changes from −100 V to −400 V. In contrast, in the region 03, the potential difference becomes insufficient so that discharging is less likely to occur, possibly causing the surface potential to remain at −300 V. Thus, in a state where charge removal is insufficient, defective charging may possibly occur due to the residual electric charge of the image corresponding to a previous rotation of the photoconductor drum 01.

In particular, in a configuration not having a charge remover that removes electric charge by using light, that is, a so-called erase lamp, the removal of residual electric charge during an image forming operation is dependent on self-discharge or is executed by using a functional member provided for another purpose (i.e., the first-transfer rollers in the first exemplary embodiment). However, because the functional member is optimized for its original purpose during an image forming operation (i.e., for its transfer function in the first exemplary embodiment), the functional member may be not optimal for obtaining the charge removing effect. In that case, residual electric charge may occur readily. In a configuration that performs charging by using a direct-current power source alone for the charging rollers CRy to CRk, the charging ability is lower than in the case where an alternating-current voltage is superposed on a direct-current voltage, thus causing the effect of the residual electric charge to remain in the charging process.

In contrast, in the copier U according to the first exemplary embodiment, control is performed during an image forming operation for increasing the charge bias Vdc to be supplied to the charging rollers CRy to CRk as the photoconductor drums PRy to PRk rotate. Therefore, in the second rotation of the photoconductor drums PRy to PRk, the charge bias Vdc is increased by the increment ΔV, as compared with the first rotation. Thus, in the example in FIG. 7, when the charge bias of the charging roller is, for example, −500 V during the second rotation, the potential difference with the region 03 is 200 V so that discharging tends to occur readily, whereby the occurrence of defective charging may be reduced. In the third and fourth rotations of the photoconductor drums PRy to PRk in the first exemplary embodiment, the charge bias Vdc is similarly increased from the previous rotation. Therefore, in the copier U according to the first exemplary embodiment, the potential difference may be prevented from becoming too small even if the surface potential of the photoconductor drums PRy to PRk immediately before the charging process is not sufficiently reduced, as in the region 03, as compared with the related art in which the electric potential in the charging device is maintained during the image forming operation. Accordingly, the occurrence of defective charging may be reduced, so that image defects and image-quality deterioration may be reduced.

Furthermore, in the first exemplary embodiment, the development bias VB and the output of the LED heads LHy to LHk are also controlled in accordance with the increase of the charge bias Vdc. Therefore, as shown in FIGS. 5A, 5B, and 6B, the potential difference among the charge bias Vdc, the development bias VB, and the latent-image potential VL is maintained. Thus, the development conditions are maintained, and the image density may be prevented from deviating from the target density. Consequently, the occurrence of defective development may be suppressed, as compared with a case where the development bias VB and the latent-image potential VL are not in conjunction with each other.

In the first exemplary embodiment, the control for increasing the charge bias Vdc as the photoconductor drums PRy to PRk rotate during an image forming operation is executed in the case where the first-transfer bias does not reach the threshold value Ia. Therefore, if the first-transfer bias exceeds the threshold value Ia, the first-transfer rollers T1*y* to T1*k* have a sufficient charge removing ability. In such a case, increasing the charge bias Vdc leads to a waste of electric power. Therefore, in the first exemplary embodiment, the control for increasing the charge bias Vdc is performed when the charge removing ability is insufficient.

Furthermore, in the first exemplary embodiment, the control for increasing the charge bias Vdc is performed when the image density is high. When the image density is high, the amount of toner entering the first-transfer regions Q3*y* to Q3*k* increases. The toner is electrostatically charged, and the total charge amount in an image increases with increasing amount of toner. When the amount of electric charge in images between the photoconductor drums PRy to PRk and the first-transfer rollers T1*y* to T1*k* increases, it becomes difficult to remove the electric charge from the photoconductor drums PRy to PRk by using the first-transfer bias supplied to the first-transfer rollers T1*y* to T1*k*. Specifically, defective charging tends to occur due to defective charge removal. In contrast, in the first exemplary embodiment, if the image density is high, the charge bias Vdc is increased so that the occurrence of defective charging may be suppressed. In the case of a low image density in which defective charging is less likely to occur, the control for increasing the charge bias Vdc is not performed so as to save power.

Furthermore, in the case of the full-color mode, images stacked on the intermediate transfer belt B at the upstream side also enter the first-transfer regions Q1*m* to Q1*k* at the downstream side. Therefore, the amount of toner entering the first-transfer region Q1*k* for the K color increases, as compared with the case of the monochrome mode using the K color, thus making the charge removing ability difficult. In the first exemplary embodiment, control is performed such that the image forming rate is set to a low rate in the full-color mode and the charge bias Vdc is increased. Thus, in the full-color mode, the occurrence of defective charging may be suppressed. In the monochrome mode in which defective charge removal is less likely to occur, the control for increasing the charge bias Vdc is not performed so as to save power.

Furthermore, in the first exemplary embodiment, the increments ΔV and ΔV' are set based on the upper limit value Vmax of the charge voltage. Therefore, the charge bias Vdc is not set to exceed the upper limit value Vmax of the charge voltage so that safety is ensured, as compared with a case where the increments ΔV and ΔV' are set without taking into consideration the upper limit value Vmax of the charge voltage. Moreover, the increments ΔV and ΔV' are set based on the length of the image region L1, and increments ΔV and ΔV' as large as possible are set within the upper limit value Vmax in accordance with the length of the image region L1. Consequently, the potential difference with the region 03 in FIG. 7 may be readily increased, as compared with a case where the increments ΔV and ΔV' are fixed for all sheet sizes, whereby the occurrence of defective charging may be reduced.

In the first exemplary embodiment, a charge remover is not provided, and defective charging is dealt with by controlling the charge bias. Therefore, the number of components and the manufacturing costs may be reduced while defective charging may be suppressed, as compared with a configuration provided with a charge remover.

Furthermore, in the first exemplary embodiment, the charging rollers CRy to CRk are supplied with electric power from a direct-current power source. Therefore, in the first exemplary embodiment, a low-cost configuration with a low charging ability may be employed while the occurrence of defective charging may be suppressed, as compared with a case where an alternating-current voltage is superposed on a direct-current voltage.

Modifications

Although the exemplary embodiment of the present invention has been described in detail above, the present invention is not to be limited to the above exemplary embodiment and permits various modifications within the technical scope of the invention defined in the claims. Modifications H01 to H013 will be described below.

In a first modification H01, the image forming apparatus according to the above exemplary embodiment is not limited to the copier U, and may be, for example, a printer, a facsimile apparatus, or a multifunction apparatus having multiple functions or all functions of such apparatuses.

In the copier U according to the above exemplary embodiment, developers for four colors are used. Alternatively, for example, in a second modification H02, the exemplary embodiment may also be applied to a monochrome image forming apparatus or a multicolor image forming apparatus that uses five or more colors or three or fewer colors. Furthermore, although images are transferred from the photoconductor drums PRy to PRk as an example of image bearing members onto the intermediate transfer belt B as an example of a medium in the first exemplary embodiment, the exemplary embodiment is not limited to the configuration having the intermediate transfer belt B. For example, the exemplary embodiment is also applicable to a configuration that directly transfers an image from a photoconductor onto paper or an OHP sheet as an example of a medium.

In the above exemplary embodiment, the numerical values and materials are not limited to those exemplified. In a third modification H03, the numerical values and materials may be changed, where appropriate, in accordance with the design and specifications.

In the above exemplary embodiment, an image is determined to be a high-density image if the image density derived from the number of pixels in images to be written by the LED heads LHy to LHk for all colors reaches a predetermined threshold value, and control for increasing the charge bias Vdc in the charging rollers CRy to CRk for all colors is performed. However, the exemplary embodiment is not limited to this configuration. On the intermediate transfer belt B entering the first-transfer region of a downstream engine, the transfer toner transferred at an upstream engine is disposed. In particular, the higher the density of the image by the upstream engine, the larger the amount of transfer toner. Therefore, defective charge removal progresses faster in the first-transfer region of the downstream engine. Thus, in a fourth modification H04, it may be determined whether or not an image is a high-density image from the density of the image by the upstream engine, and if the image is a high-density image, the control for increasing the charge bias Vdc may be performed with respect to the downstream engine alone. The determination of whether or not the image by the upstream engine is a high-density image is performed by determining whether or not the image density derived from the number of pixels in the image written by the LED head corresponding to the upstream engine reaches a predetermined threshold value. In this case, the separation line between the upstream engine and the downstream engine may be located anywhere. If the engines are arranged in the order Y, M, and so on (or M, Y, and so on) from upstream, Y and M engines may be defined as upstream engines, and the engines downstream therefrom may be defined as downstream engines (i.e., C and K engines are defined as downstream engines in the case of Y, M, C, and K engines). In this case, the occurrence of defective charge removal may be suppressed at the downstream engines, where it is assumed that the occurrence frequency is relatively high, when a high-density red image is to be formed by using the Y and M colors. If the control is to be further simplified, the determination of whether or not an image is a high-density image may be performed from an image by an upstream engine, and the control for increasing the charge bias Vdc may be performed at all engines.

Although it is desirable to perform the control for increasing the charge voltage Vdc when the image density is high and to not perform the control for increasing the charge voltage Vdc when the image density is low in the above exemplary embodiment, the exemplary embodiment is not limited to this configuration. In a fifth modification H05, the charge voltage Vdc may be increased in a case where the density is low. Specifically, the charge voltage Vdc may be increased regardless of the image density.

In the above exemplary embodiment, the charge voltage Vdc is increased by varying the image forming rate between the monochrome mode and the full-color mode. However, the exemplary embodiment is not limited to this configuration. In a sixth modification H06, while an image forming operation is performed at the same image forming rate between the monochrome mode and the full-color mode, the control for increasing the charge voltage Vdc may be performed in the full-color mode and the control for increasing the charge voltage Vdc may be not performed in the monochrome mode. Although it is desirable not to perform the control for increasing the charge voltage Vdc in the monochrome mode, the exemplary embodiment is not limited to this configuration. The control for increasing the charge voltage Vdc in the monochrome mode may also be performed in the monochrome mode.

The above exemplary embodiment relates to a case where the image forming rate has two levels, that is, a high rate and a low rate. Alternatively, in a seventh modification H07, the exemplary embodiment may be applied to a case where the image forming rate has three or more levels. In a case where the three levels include a high rate, an intermediate rate, and a low rate, the threshold value Ia may be set such that it is determined that the charge removing ability is insufficient only at the low rate, or may be set such that it is determined that the charge removing ability is insufficient only at the low rate and the intermediate rate.

Although the above exemplary embodiment relates to a case where the charge voltage Vdc is controlled using the same value for the four colors, the exemplary embodiment is not limited to this configuration. In an eighth modification H08, the charge voltage Vdc may vary among the Y, M, C, and K colors. For example, the charge bias Vdc may be set to different values, such as a charge bias Vdcy for the Y color, a charge bias Vdcm for the M color, a charge bias Vdcc for the C color, and a charge bias Vdck for the K color.

Although it is desirable that a charge remover be not included and that a direct-current power source alone be used for the charging rollers CRy to CRk in the above exemplary embodiment, the exemplary embodiment is not limited to this configuration. In a ninth modification H09, a charge remover may be provided, and the charge remover used may be configured by superposing an alternating-current power source on a direct-current power source.

In a tenth modification H010 of the above exemplary embodiment, correction control for coping with deterioration of a charging unit indicated in the related art may be used in combination with the control of the charge bias Vdc.

Although the increments ΔV and ΔV' are set based on the upper limit value Vmax of the charge voltage in the above exemplary embodiment, the exemplary embodiment is not limited to this configuration. In an eleventh modification H011, a fixed increment may be used regardless of the size of the image region L1. Furthermore, although it is desirable to perform control in view of the upper limit value Vmax, the increment may be set without taking into consideration the upper limit value Vmax. The control is possible so long as a value obtained by adding a total increase Vtotal of the charge voltage to an initial value Vdc0 of the charge voltage is smaller than or equal to the upper limit value Vmax.

In the above exemplary embodiment, control is performed such that the charge bias Vdc, the development bias VB, and the latent-image potential VL increase in conjunction with one another. However, the exemplary embodiment is not limited to this configuration. For example, in a twelfth modification H012, if defective development is within a permissible range, the charge bias Vdc alone may be increased while the development bias VB is maintained at a fixed value, or the output when forming latent images by using the LED heads LHy to LHk may be fixed.

In the case where the development bias VB is set to a fixed value or the output when forming latent images by using the LED heads LHy to LHk is fixed, there is a concern that the density may change in the rotational direction of the photoconductor drums PRy to PRk within the image region L1. Thus, the total increase Vtotal of the charge bias Vdc is kept constant regardless of the length of the image region L1. Thus, the density difference between one end and the other end of the image region L1 is prevented from being too large even if the image region L1 is long. Moreover, for example, the first-transfer bias and the second-transfer bias may be controlled in conjunction with an increase in the charge bias Vdc.

In the above exemplary embodiment, the interval at which the charge bias Vdc is increased in a stepwise manner corresponds to one rotation L1 of the photoconductor drums PRy to PRk. Alternatively, in a thirteenth modification H013, the interval may be set to a freely-chosen length so long as the interval corresponds to a length that is smaller than or equal to one rotation L1 of the photoconductor drums PRy to PRk.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image bearing member; and a charging member that electrostatically charges a surface of the image bearing member, wherein control is performed for increasing a voltage to be applied to the charging member in a stepwise manner every time a time period equivalent to one rotation of the image bearing member elapses so that the voltage becomes higher than when the image bearing member passes through a region where the image bearing member faces the charging member in a previous rotation, the control being performed as the image bearing member rotates while a single image region worth of image is being formed in an image region that is longer than a length equivalent to one rotation of the image bearing member in a rotational direction of the image bearing member, and wherein an increment of the voltage to be applied to the charging member in the control is set based on a length of the image region in the rotational direction of the image bearing member.

2. The image forming apparatus according to claim 1, wherein a member that removes electric charge from the surface of the image bearing member by using light is not included.

3. The image forming apparatus according to claim 1, wherein the charging member receives a direct-current voltage alone.

4. The image forming apparatus according to claim 1, wherein the increment is set to decrease with increasing length of the image region.

5. The image forming apparatus according to claim 1, wherein the increment is set based on a predetermined upper limit value of the voltage to be applied to the charging member and the length of the image region.

6. The image forming apparatus according to claim 1, further comprising:

a latent-image forming device that forms a latent image onto the electrostatically-charged image bearing surface; and a developing device that develops the latent image on the image bearing member, wherein when the voltage to be applied to the charging member is increased in the control, if an output of the latent-image forming device or a voltage to be applied to the developing device is not to be changed, a total increase of the voltage to be applied to the charging member is kept constant from one end to another end of the image region in the rotational direction of the image bearing member, regardless of a length of the image region in the rotational direction of the image bearing member.

7. The image forming apparatus according to claim 1, further comprising:

a charge removing unit including a transfer member that transfers an image on the image bearing member onto a medium and that removes electric charge from the image bearing member.

8. An image forming apparatus comprising:

an image bearing member;

a charging member that electrostatically charges a surface of the image bearing member; and a charge removing member that removes electric charge from the image bearing member electrostatically charged by the charging member, wherein control is performed for increasing a voltage to be applied to the charging member in a continuous manner so that the voltage becomes higher than when the image bearing member passes through a region where the image bearing member faces the charging member in a previous rotation, the control being performed as the image bearing member rotates while a single image region worth of image is being formed in an image region that is longer than a length equivalent to one rotation of the image bearing member in a rotational direction of the image bearing member, wherein an increment of the voltage to be applied to the charging member in the control is set based on a length of the image region in the rotational direction of the image bearing member.

9. An image forming apparatus comprising:

an image bearing member;

a charging member that electrostatically charges a surface of the image bearing member, wherein control is performed for increasing a voltage to be applied to the charging member in a stepwise manner every time a time period equivalent to one rotation of the image bearing member elapses so that the voltage becomes higher than when the image bearing member passes through a region where the image bearing member faces the charging member in a previous rotation, the control being performed as the image bearing member rotates while a single image region worth of image is being formed in an image region that is longer than a length equivalent to one rotation of the image bearing member in a rotational direction of the image bearing member; and a latent-image forming device that forms a latent image onto the electrostatically-charged image bearing member, wherein when the voltage to be applied to the charging member is increased in the control, an amount of light radiated by the latent-image forming device is reduced.

10. An image forming apparatus comprising:

an image bearing member;

a charging member that electrostatically charges a surface of the image bearing member, wherein control is performed for increasing a voltage to be applied to the charging member in a stepwise manner every time a time period equivalent to one rotation of the image bearing member elapses so that the voltage becomes higher than when the image bearing member passes through a region where the image bearing member faces the charging member in a previous rotation, the control being performed as the image bearing member rotates while a single image region worth of image is being formed in an image region that is longer than a length equivalent to one rotation of the image bearing member in a rotational direction of the image bearing member; and a charge removing unit including a transfer member that transfers an image on the image bearing member onto a medium and that removes electric charge from the image bearing member, wherein the control is performed when a charge removal bias to be supplied to the charge removing unit does not reach a predetermined value.

11. The image forming apparatus according to claim 10, wherein the control is not performed if a charge removal bias to be supplied to the charge removing unit reaches a predetermined value.

12. The image forming apparatus according to claim 10, wherein the image bearing member includes a plurality of image bearing members arranged in a traveling direction of the medium onto which the image is to be transferred, wherein the charging member includes a plurality of charging members arranged in correspondence with the image bearing members, and wherein in a case where a density of an image to be formed at an upstream one or more of the image bearing members in the traveling direction of the medium is higher than a predetermined density, the control is performed on the charging member corresponding to a downstream one or more of the image bearing members based on determination that the charge removal bias to be supplied to the charge removing unit does not reach the predetermined value.

13. The image forming apparatus according to claim 12, wherein the upstream one or more of the image bearing members include image bearing members onto which magenta and yellow images are to be formed, and wherein in a case where densities of the magenta and yellow images are higher than the predetermined density, the control is performed on the charging member corresponding to the downstream one or more of the image bearing members based on determination that the charge removal bias to be supplied to the charge removing unit does not reach the predetermined value.

14. The image forming apparatus according to claim 10, wherein in a case where a charge removal bias to be supplied to the charge removing unit is smaller than a predetermined value, the voltage to be applied to the charging member is increased in the charging member corresponding to the downstream one or more of the image bearing members based on determination that the charge removal bias to be supplied to the charge removing unit does not reach the predetermined value.

15. An image forming apparatus comprising:

an image bearing member;

a charging member that electrostatically charges a surface of the image bearing member;

a charge removing member that removes electric charge from the image bearing member electrostatically charged by the charging member, wherein control is performed for increasing a voltage to be applied to the charging member in a continuous manner so that the voltage becomes higher than when the image bearing member passes through a region where the image bearing member faces the charging member in a previous rotation, the control being performed as the image bearing member rotates while a single image region worth of image is being formed in an image region that is longer than a length equivalent to one rotation of the image bearing member in a rotational direction of the image bearing member;

a latent-image forming device that forms a latent image onto the electrostatically-charged image bearing surface; and a developing device that develops the latent image on the image bearing member, wherein when the voltage to be applied to the charging member is increased in the control, if an output of the latent-image forming device or a voltage to be applied to the developing device is not to be changed, a total increase of the voltage to be applied to the charging member is kept constant from one end to another end of the image region in the rotational direction of the image bearing member, regardless of a length of the image region in the rotational direction of the image bearing member.

* * * * *